United States Patent [19]

Jordan et al.

[11] 4,091,852

[45] May 30, 1978

[54] INFLATABLE BOX

[76] Inventors: Charles P. Jordan, 203 Fairlane Dr.; Claire L. McGuire, 2614 Fairway Dr., both of Joliet, Ill. 60435

[21] Appl. No.: 786,353

[22] Filed: Apr. 11, 1977

[51] Int. Cl.[2] ..... A45C 7/00

[52] U.S. Cl. ..... 150/.5; 206/522

[58] Field of Search ..... 150/.5; 206/522; 62/457, 459, 371, 530

[56] References Cited

U.S. PATENT DOCUMENTS

| | | | |
|---|---|---|---|
| 1,482,727 | 2/1924 | Borchers | 150/.5 UX |
| 2,144,318 | 1/1939 | Kryder | 150/.5 |
| 3,207,357 | 9/1965 | Schmitt | 229/31 R X |
| 3,262,283 | 7/1966 | Taylor | 62/457 X |
| 3,552,466 | 1/1971 | Fairchilds | 206/522 X |
| 3,619,825 | 11/1971 | Taub | 206/522 X |
| 3,904,106 | 9/1975 | Elder | 229/31 R |

FOREIGN PATENT DOCUMENTS

| | | | |
|---|---|---|---|
| 848,248 | 9/1960 | United Kingdom | 206/522 |

*Primary Examiner*—Donald F. Norton
*Attorney, Agent, or Firm*—Ernest S. Kettelson

[57] ABSTRACT

An inflatable box of resilient sheet material such as rubber or vinyl, comprising a plurality of inflatable panels integrally joined along fold lines to provide a bottom wall, side walls and a top wall which may also function as an openable cover. The box may be made water-tight by providing non-inflatable folds or webs of waterproof material integrally joining each side panel to the side panels adjacent thereto along their respective adjoining edges. An air valve is provided in one of the inflatable panels to introduce air under pressure in that panel, and into the other inflatable panels through connecting passageways. The panels are inflated when they are lying flat. They are then folded along fold lines to form the box, and the panels are held in such position by side wall fasteners. A fastener may also be provided on the top cover panel to hold it in closed position. The air filled inflatable panels provide good insulation against heat transfer, so the box is particularly useful as an ice chest and for storing or transporting items packed in ice. When not being used as a box or container, the panels may be deflated whereupon the box may be folded into a compact unit for storage.

6 Claims, 7 Drawing Figures

INFLATABLE BOX

BACKGROUND OF THE INVENTION

This invention relates to the field of collapsible containers of resilient sheet material, comprising interconnected panels to form the bottom and peripheral side walls. Typical of such devices found in the prior art are those described in U.S. Pat. No. 3,743,130 to Jorgensen, U.S. Pat. No. 3,442,397 to Donovan et al, U.S. Pat. No. 3,347,060 to Barkan, U.S. Pat. No. 3,387,650 to Hoffman et al, and U.S. Pat. No. 3,262,283 to Taylor.

In accordance with the present invention, a collapsible container is provided which has inflatable panels to form the bottom and side walls, each panel being integrally joined to one or more panels along fold lines, whereby when inflated the panels each assume a flat configuration having substantially planar wall surfaces and when folded along the fold lines to an angular position with respect to each adjoining panel, they form bottom and peripheral side walls. An additional panel may be joined to one of the side walls to form a top wall or openable cover for the box. Thus, the collapsible container in accordance with this invention may be folded into a small unit when deflated, and when inflated it may be formed into a box of substantial dimension and storage capacity. In addition, when inflated with air the panels have good insulating characteristics making the container particularly useful as an ice chest. It is particularly useful for such purposes as fishing trips, where a large water-tight insulated chest is needed to transport a catch of fish on the way home, but where space is at a premium on the way to the fishing location making a collapsible chest which can be folded into a small compact unit highly desirable.

None of the prior art devices satisfy these objectives as well as the present invention, nor do they combine all of the features of the inflatable foldable box in accordance with the present invention.

SUMMARY OF THE INVENTION

It is an object of the invention to provide an inflatable collapsible box comprising a plurality of inflatable panels of flexible sheet material integrally joined along fold lines to provide a bottom wall, side walls and an openable cover to serve as a top wall.

It is an object of the invention to provide an inflatable collapsible box which is collapsible and foldable into a small compact unit when deflated and which forms a box of large storage capacity when inflated.

It is an object of the invention to provide an inflatable collapsible box comprising a plurality of inflatable panels integrally joined along fold lines to provide a bottom wall and side walls, and non-inflatable webs integrally joining each side panel to adjacent side panels, the panels and webs being made of waterproof sheet material to provide a liquid tight container when folded to form a box.

DESCRIPTION OF A PREFERRED EMBODIMENT

Figure 1:
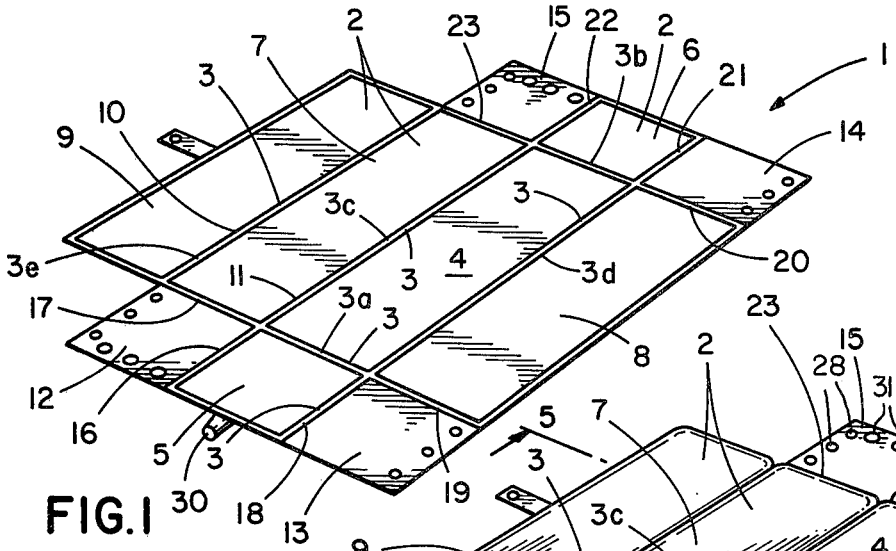
FIG. 1 is a perspective view of an inflatable collapsible box in accordance with this invention shown with the panels laying flat and deflated.

An inflatable collapsible box 1 in accordance with this invention includes a plurality of inflatable panels 2 integrally joined to at least one other inflatable panel 2 along fold lines. 3. The inflatable panels 2 include a bottom wall panel 4, four side wall panels including two short side wall panels 5 and 6 integrally joined to opposite short edges of bottom wall panel 4 along respective fold lines *3a* and *3b*, and two long side wall panels 7 and 8 integrally joined to opposite long edges of bottom wall panel 4 along respective fold lines *3c* and *3d*, plus a top wall panel 9 integrally joined to long side wall panel 7 along fold line *3e* extending along the edge 10 of panel 7 opposite the edge 11 which is integrally joined to bottom wall panel 4.

In addition to the inflatable panels 2 which form wall panels 4 – 9, there are four non-inflatable panels or webs 12 – 15 which are integrally joined respectively to adjacent inflatable side wall panels 5 – 8 along their respective adjacent edges. Web 12 is integrally joined to inflatable side wall panel 5 along its edge 16 and to adjacent inflatable side wall panel 7 along its edge 17. Web 13 is integrally joined to inflatable side wall panel 5 along its opposite edge 18 and to adjacent inflatable side wall panel 8 along its edge 19. Web 14 is integrally joined to inflatable side wall panel 8 along its opposite edge 20 and to adjacent side wall panel 6 along its edge 21. Web 15 is integrally joined to inflatable side wall panel 6 along its opposite edge 22 and to adjacent side wall panel 7 along its edge 23.

Webs 12 – 15 are formed of a single ply of waterproof resilient sheet material such as rubber or one of the flexible plastic sheet materials.

The inflatable panels 2 which form wall panels 4 – 9 are made of airtight flexible sheet material such as rubber. Other flexible sheet materials may be used including vinyl or other flexible plastics which are impervious to the passage of air. The inflatable panels 2 forming wall panels 4 – 9 are made as follows. A first ply 24 of airtight resilient sheet material is cut in the form generally of a rectangle but having a pair of generally squared projections 25 and 26, one extending outwardly from each opposite long side of the rectangular sheet. The short sides of the rectangular sheet correspond in length to the long edges of the long side wall panels 7 and 8 as well as of the bottom wall panel 4 and top wall panel 9. The long sides of the rectangular sheet correspond in length to four times the length of the short edges of the side wall panels 7 or 8. In other words, the combined length of the short edges of side wall panels 7 and 8, of top wall panel 9, plus that of bottom wall panel 4, is equal to the length of the long sides of the rectangular sheet 24.

The dimensions of the outwardly extending projections 25 and 26 correspond to the peripheral edges of short side wall panels 5 and 6.

A second ply 27 of airtight resilient sheet material of dimensions and configuration corresponding to that of the first ply 24 is overlaid on the first ply 24. The two plies 24 and 27 are bonded together around their peripheral edges to provide an air tight seal. Then the fold lines 3 which divide the two plies of sheet material into the inflatable panels 2 forming bottom wall panel 4, side wall panels 5 - 8 and top wall panel 9 are formed by bonding at least a substantial portion of each ply 24 and 27 together along fold lines 3*a* - 3*e* respectively. The partially bonded fold line 3*a* divides short side wall panel 5 from one short edge of bottom wall panel 4. Fold line 3*b* divides short side wall panel 6 from the opposite edge of bottom wall panel 4. The fold line 3*c* divides long side wall panel 7 from one long edge of bottom wall panel 4. The fold line 3*d* divides long side wall panel 8 from the opposite edge of bottom wall panel 4. The fold line 3*e* divides the top wall panel 9 from long side wall panel 7.

By bonding the two plies of sheet material 24 and 27 together along only a portion of each of the fold lines, air passageways are provided to enable the flow of air from one inflatable panel 2 to another inflatable panel 2 as the device is inflated through air valve 30. The plies are bonded together along a substantial enough length of the fold lines 3 to enable each panel to be individually definable as a separate panel when inflated and to enable each such individually definable panel to be folded along such fold line when the respective panels are fully inflated.

When the panels have been folded to form a box, the snap fasteners 28 and 28' are secured together to hold the panels in the box configuration. Snap fasteners 29 and 29' secure the top wall panel 9 in the closed position.

Figure 2:
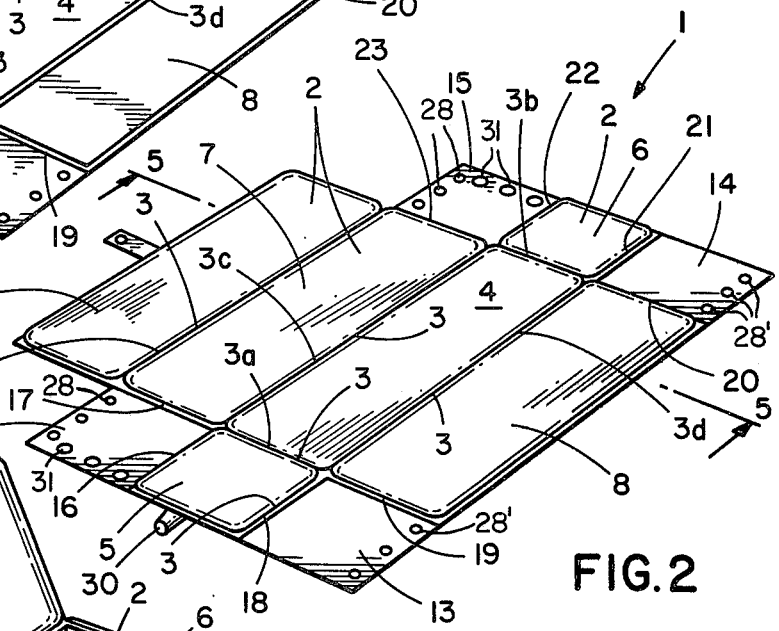
FIG. 2 is a perspective view of the inflatable collapsible box of FIG. 1 with the panels laying flat and with the inflatable panels inflated.
Figure 3:
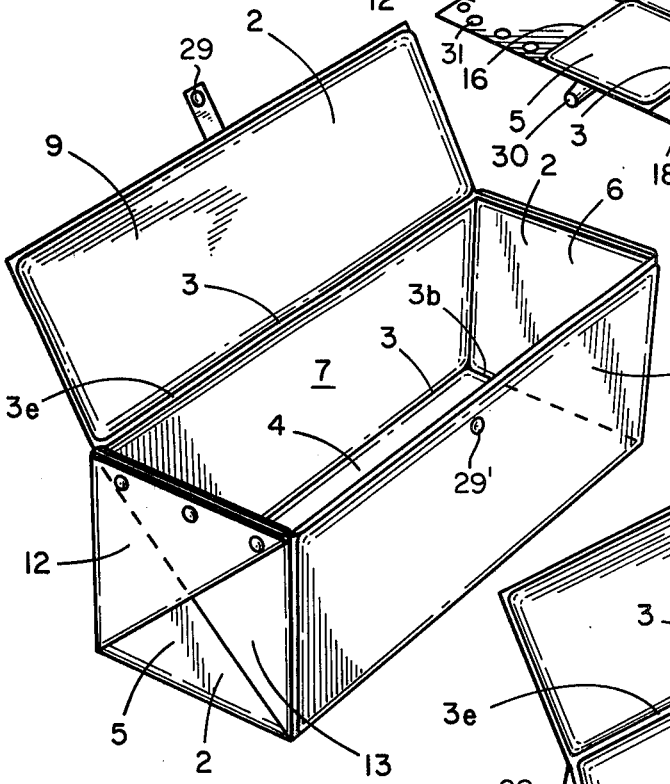
FIG. 3 is a perspective view of the inflatable collapsible box of FIG. 2 with the inflated panels folded to form a bottom wall, side walls and a top wall which serves as an openable cover.
Figure 4:
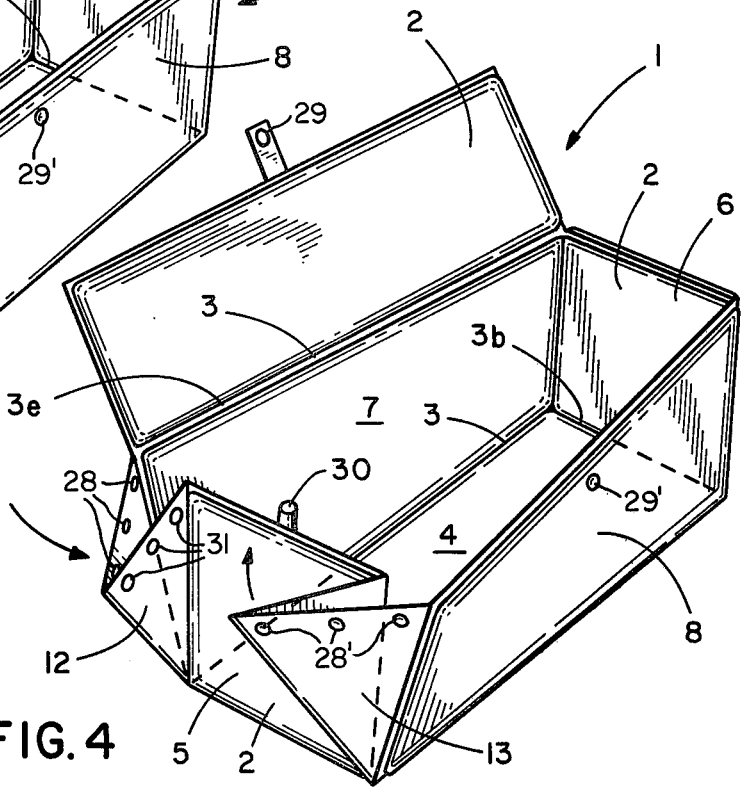
FIG. 4 is a perspective view of the inflatable collapsible box of FIG. 3 showing one side wall panel and its integrally joined webs in partially folded position.
Figure 5:
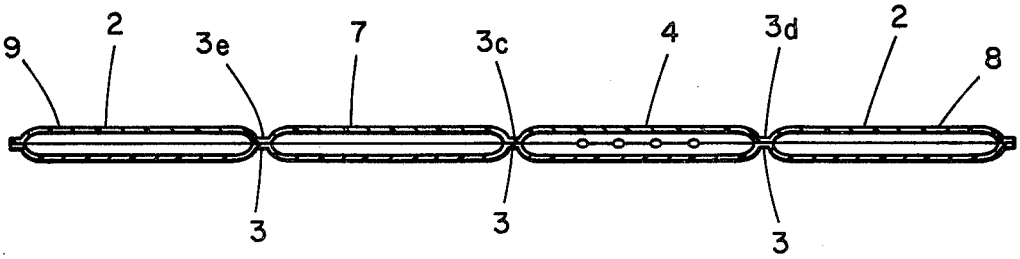
FIG. 5 is a section view taken on line 5 — 5 of FIG. 2.
Figure 6:
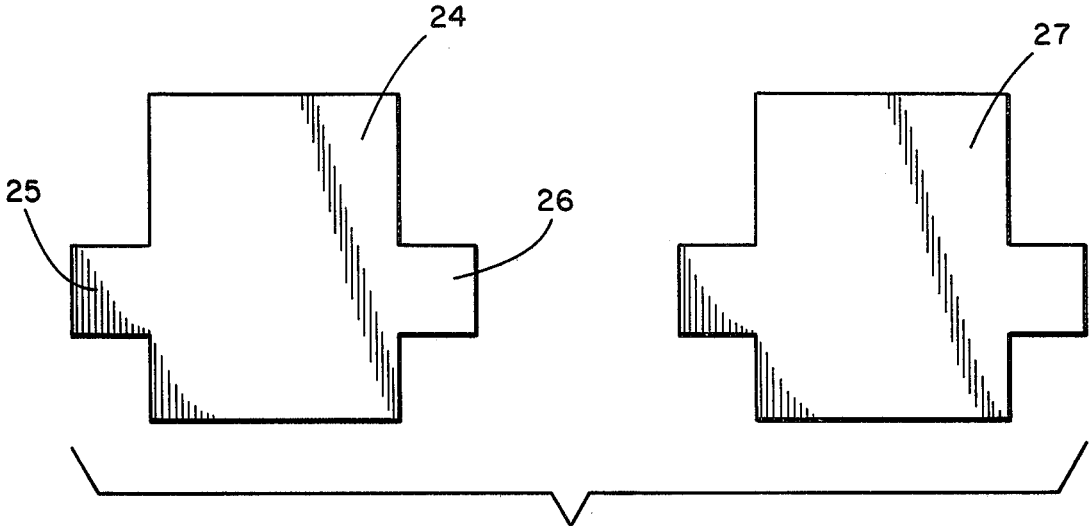
FIG. 6 is a plan view of two sheets of single ply sheet material shown in side by side relationship for use in making an inflatable box in accordance with this invention.

The snap fasteners 28 and 28' are provided on the non-inflatable webs 12 - 15 as shown in FIG. 2. The snap fasteners may be positioned along opposite outer side edges of non-inflatable webs 12 and 13 for mating together as shown in FIG. 3 to secure the inflatable panels in the box configuration as shown. The non-inflatable panels 12 and 13 are folded into triangular folds as shown in FIG. 4, with the snap fasteners on the outer side edge of panel 13 facing outwardly to be tucked under the corresponding triangular fold of panel 12 which is then folded against and outside of the triangular fold of panel 13 as illustrated in FIGS. 3 and 4. Panel 12 includes corresponding apertures 31 as illustrated in FIGS. 2 and 4 along the outer end edge of panel 12 perpendicular to its outer side edge on which the snap fasteners are positioned. Thus, as shown in FIG. 4, when triangularly folded panel 12 is folded against and outside of triangularly folded panel 13, the apertures line up with the corresponding mating parts of snap fasteners 28 and 28' enabling them to be snapped together as shown in the assembled box of FIG. 3.

The snap fasteners 28 and 28' provided on non-inflatable panels 14 and 15 at the opposite end of the box are positioned and function in the same manner as described for panels 12 and 13.

Such snap fasteners enable the inflatable panels to be held together in a box configuration.

Figure 7:
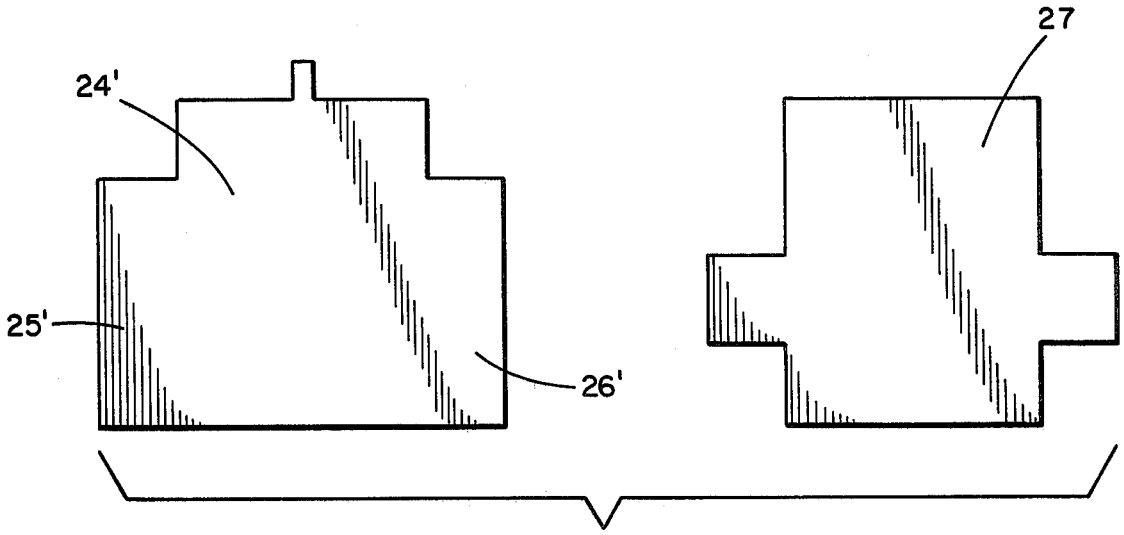
FIG. 7 is a plan view of a modification of one of the single ply sheets for use in making an inflatable box in accordance with this invention, with a second ply of sheet material shown alongside which will be overlaid on the first sheet.

The single ply webs 12 - 15 may be bonded separately to adjacent side edges of the inflatable panels 2, or they may be formed as part of one of the sheets of material which make up plies 24' and 27'. In such case, as shown in FIG. 7 one of the sheets 24' is cut such that the outwardly extending projections 25' and 26' correspond in length on their long sides to the length of the short side wall panels 5 and 6 respectively, plus the length of each web 12 and 13 on one side and 14 and 15 on the opposite side. The other sheet 27' is cut as previously described with respect to sheet or ply 27, so when overlaid on sheet 24' it will provide a two ply thickness for the portion which will form the inflatable panels 2 and will leave only a single ply for the portion which will form the non-inflatable webs 12 - 15.

The short side wall panels 5 and 6 may be square. The long side wall panels 7 and 8 may be rectangular. The bottom wall panel 4 may be rectangular, as may the top wall panel 9. The said panels may be of other peripheral configurations within the scope of this invention.

An air valve 30 is provided to inflate and deflate the inflatable panels 2.

We claim

1. An inflatable container, comprising a plurality of waterproof inflatable panels, including a bottom inflatable panel, a first end inflatable panel adjacent one end of said bottom inflatable panel, a first side inflatable panel adjacent one side of said bottom inflatable panel, a second side inflatable panel adjacent the opposite side of said bottom inflatable panel, a plurality of waterproof non-inflatable panels of flexible sheet material each having four sides adjacent ones of which are substantially normal to each other and opposite ones of which are substantially parallel to each other, a first of said non-inflatable panels having a first side edge connected along a side of said first end inflatable panel and a second side edge connected along an adjacent side of said first side inflatable panel, a third side edge of said first non-inflatable panel including first fastener means thereon for cooperative fastening engagement with second fastener means, a second of said non-inflatable panels having a first side edge connected along an opposite side of said first end inflatable panel and a second side edge connected along an adjacent side of said second side inflatable panel, a third side edge of said second non-inflatable panel including said second fastener means thereon for cooperative fastening engagement with said first fastener means when said bottom, side and end inflatable panels are folded into a box configuration, said first non-inflatable panel is triangularly folded on itself and folded against said first end inflatable panel, said second non-inflatable panel is triangularly folded on itself and folded against said first non-inflatable panel whereupon said first and second fastener means come into registration with each other for fastening engagement together.

2. An inflatable container as set forth in claim 1, wherein said inflatable panels include a first ply of flexible sheet material and a second ply of flexible sheet material overlaid thereon and bonded thereto around a peripheral portion thereof.

3. An inflatable container as set forth in claim 1, wherein said bottom panel is rectangular, and at least two of said side panels are rectangular.

4. An inflatable container as set forth in claim 1, wherein said bottom panel and side panels are rectangular and said end panel is square.

5. An inflatable container as set forth in claim 4, including a top panel, said top panel being connected along one edge to a corresponding edge of one of said rectangular side panels.

6. An inflatable container as set forth in claim 1, including a second end inflatable panel adjacent said bottom inflatable panel at its end opposite that adjacent said first end inflatable panel, a third of said non-inflatable panels having a first side edge connected along a side of said second end inflatable panel and a second side edge connected along an adjacent side of said first side inflatable panel, a third side edge of said third non-inflatable panel including a third fastener means thereon for cooperative fastening engagement with fourth fastener means, a fourth of said non-inflatable panels having a first side edge connected along an opposite side of said second end inflatable panel and a second side edge connected along an adjacent side of said second side inflatable panel, a third side edge of said fourth non-inflatable panel including said fourth fastener means thereon for cooperative fastening engagement with said third fastener means when said bottom, side and end inflatable panels are folded into a box configuration, said third non-inflatable panel is triangularly folded on itself and folded against said second end inflatable panel, said fourth non-inflatable panel is triangularly folded on itself and folded against said third non-inflatable panel whereupon said third and fourth fastener means come into registration with each other for fastening engagement together, said first, second, third and fourth fastener means when so engaged in fastening engagement respectively holding said inflatable panels together in a box configuration to provide a waterproof container.

* * * * *